US005295870A

United States Patent [19]

Rei et al.

[11] Patent Number: 5,295,870

[45] Date of Patent: Mar. 22, 1994

[54] MODULAR ELECTRICAL ASSEMBLY AND REMOVABLE WEDGE THEREFOR

[75] Inventors: Mark W. Rei, Birmingham; Allen F. VanDerStuyf, Novi; Christopher J. Volpe, Ferndale, all of Mich.

[73] Assignee: Electro-Wire Products, Inc., Dearborn, Mich.

[21] Appl. No.: 989,145

[22] Filed: Dec. 11, 1992

[51] Int. Cl.[5] ..... H01R 9/22

[52] U.S. Cl. ..... 439/717; 439/715

[58] Field of Search ..... 439/712, 713, 714, 715, 439/716, 717, 752, 701, 689, 352; 285/319, 321; 403/321, 326, 319

[56] References Cited

U.S. PATENT DOCUMENTS

| | | | |
|---|---|---|---|
| 3,042,895 | 7/1962 | Bonhomme | 339/176 |
| 3,474,397 | 10/1969 | Piasecki | 339/198 |
| 3,771,104 | 11/1973 | Clark | 339/31 R |
| 4,269,470 | 5/1981 | Ustin | 339/198 H |
| 4,343,528 | 8/1982 | Lucius et al. | 339/198 G |
| 4,469,393 | 9/1984 | Cheuning, Jr. et al. | 439/717 |
| 4,611,879 | 9/1986 | Bullard | 439/717 |
| 5,059,142 | 10/1991 | Ohta et al. | 439/752 |
| 5,071,373 | 12/1991 | Nagasaka et al. | 439/752 |
| 5,100,336 | 3/1992 | Burgess et al. | 439/277 |

*Primary Examiner*—Gary F. Paumen
*Assistant Examiner*—Hien D. Vu
*Attorney, Agent, or Firm*—Krass & Young

[57] ABSTRACT

A modular electrical connector assembly for use with the wiring systems of vehicles. The assembly includes a plurality of modular blocks, each having one or more tapering mortises formed on the sides thereof and a plurality of tubular, singled walled, double tenon wedges which are insertable into the mortises to assemble the blocks together. Preferably, wedges are formed with an upwardly tapering ramp disposed on each tenon which terminates in an upwardly depending stop surface for engagement with a downwardly depending stop surface formed on the mortises of the modular blocks to prevent relative verticle motion between the blocks and the wedges.

18 Claims, 3 Drawing Sheets

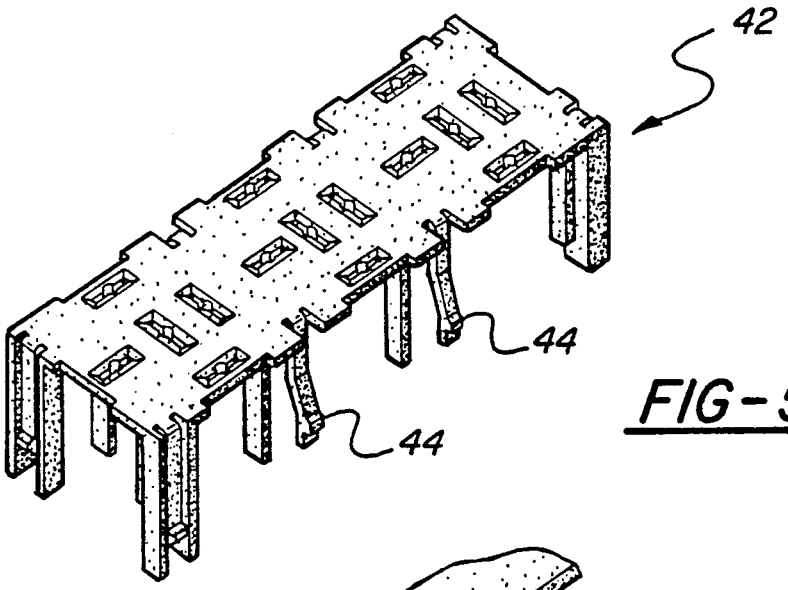
FIG-5
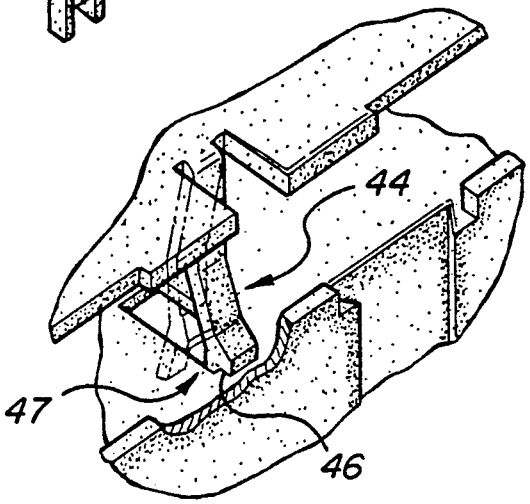
FIG-5A
FIG-6
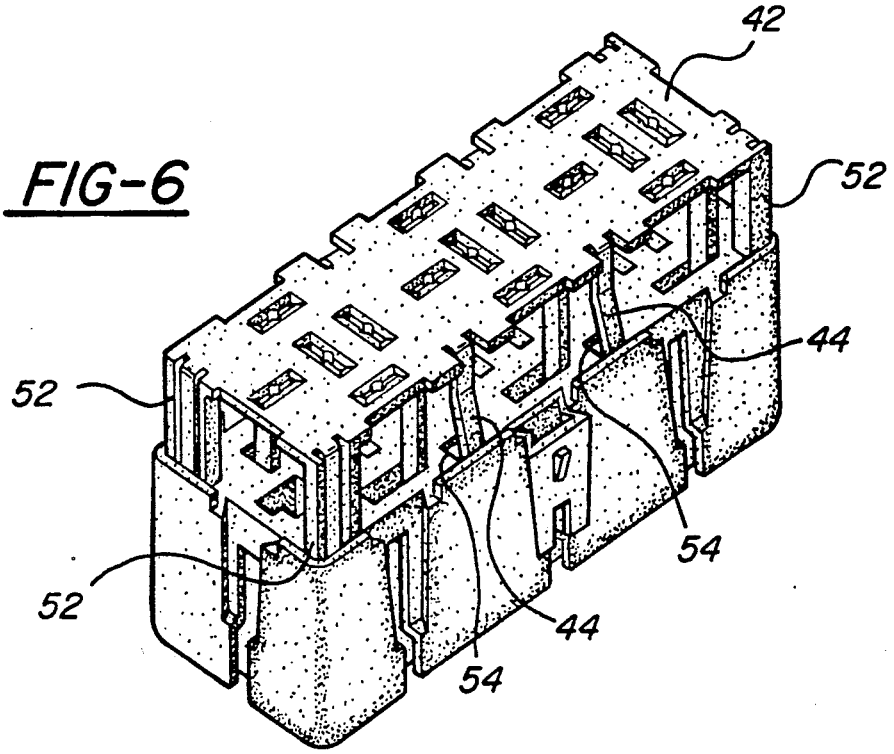

MODULAR ELECTRICAL ASSEMBLY AND REMOVABLE WEDGE THEREFOR

FIELD OF THE INVENTION

This invention relates generally to electrical connectors and particularly to an electrical connector assembly composed of a plurality of individual modules adapted to receive a variety of electrical connection members therein and which are arrangeable into a number of configurations by use of a wedge member which interlocks the individual modules.

BACKGROUND OF THE INVENTION

The electrical systems of motor vehicles of all types are becoming increasingly complex, requiring correspondingly more complex electrical connection or interface boards to accommodate the wiring. These boards include a variety of appropriate electrical connectors for connection of wires and cables from the wiring system (which generally enter the board at the rear face thereof) to appropriate electrical components (such as relays, fuses, and terminals) which plug in to suitable openings formed on the front of the board.

Of course, modern vehicles are equipped with various and sundry electrical devices. Depending on the options selected, even two vehicles of the same model may vary in the complexity of their wiring systems. Certainly, there is tremendous variation from one model to another. If an integrally formed connection board is provided for each vehicle, either a variety of custom boards must be produced, which is expensive and inefficient, or a standard board must include capacity for the most complex system; in that case, much of the board's capacity is wasted when used on vehicles with simpler wiring systems. This also represents inefficiency and waste.

To address these concerns, modular electrical connection boards have been developed. See, for example, U.S. Pat. Nos.: 3,042,895; 3,474,397; 3,771,104; 4,269,470; 4,343,258; and 4,611,879. In some cases, modular blocks into which individual electrical components are inserted are attachable directly to each other, such as is the case in, for example, U.S. Pat. No. 3,771,104. In other cases, the individual, modular blocks are joined by means of an intermediate wedge, such as is disclosed in U.S. Pat. No. 4,611,879. However, a problem is encountered with both types of modular systems in that the environment in which they operate (generally under the hood of a vehicle) is subjected to considerable thermal and mechanical stress. Particularly, when the joint is heated, the female member thereof "relaxes," thereby causing the joint to loosen.

Furthermore, alignment problems are often encountered after assembling the modular blocks together to make up the interconnect board. Such misalignments can make it difficult to correctly insert the appropriate electrical components into the board in their correct positions and can result in bad electrical contact.

It would be desirable to provide a modular electrical connection system which overcomes the deficiencies of the prior art and has joints between the various members thereof which maintain their integrity when subjected to thermal and mechanical stress. It would also be particularly advantageous to have such a system wherein means are provided for aligning the electrical components with respect to the modular blocks of the system before they are permanently locked in.

SUMMARY OF THE INVENTION

Disclosed and claimed herein is a modular electrical connector assembly for connection of various electrical components to the wiring system of, for example, a vehicle. The assembly comprises a plurality of modular, parallelepieped blocks, each having opposed top and bottom surfaces and two pairs of opposed sides. Socket means are formed in the top surface thereof which are configured to accommodate a variety of electrical components, such as, for example, a fuse, a relay, a terminal, etc.

Each block is also formed to have at least one inwardly tapering mortise formed on one of the opposed sides. The mortise is oriented to extend from proximate the top surface of the block to proximate the bottom surface thereof. In some cases, the block will include a plurality of such mortises such as, for example, one mortise formed on each of the four sides of the block, a plurality of mortises formed on one or more sides, or a combination of both.

The assembly further comprises a plurality of tubular wedges which are each configured to include a pair of opposed, outwardly flaring tenons for mating engagement with the mortises of the blocks to form a dovetail joint between each such engaged mortise and tenon.

To maintain the integrity of the dovetail joints under operating conditions, the blocks may be made of a material having a coefficient of thermal expansion different from that of which the wedges are formed. Therefore, heating of the joint cause swelling of the mortise relative to the tenon, thereby tightening the joint, rather than loosening it.

In a particular embodiment, the assembly further includes a prelocking wedge retained in at least one of the modular blocks and being operable in cooperation with the socket of the modular block to retain the electrical element therein. The prelocking wedge is retained in the modular block so as to be biasable from a first preloaded orientation wherein the electrical element may be readily inserted into the socket to a second, locked orientation wherein the wedge and socket cooperate to retain the electrical element. Preferably, the prelocking wedge is provided with at least one extending, resilient finger member which is insertable into an aperture formed in the block. The finger member has a stop formed on a free end thereof such that the stop engages a corresponding stop surface formed on an edge of the corresponding aperture in the modular block. Inward displacement of the finger member disengages the stop from the stop surface so that the finger member enters the aperture, thus allowing the wedge to move to a second, locked position.

BRIEF DESCRIPTION OF THE DRAWINGS

The following detailed description may best be understood with reference to the following drawings, in which:

FIGS. 5 and 5A are, respectively, perspective views of the prelocking wedge of the present invention and a detail thereof showing the structure of a locking finger; and FIG. 6 shows the assembly of the present invention, with the prelocking wedge in the first position.

DETAILED DESCRIPTION OF THE PREFERRED EMBODIMENTS

Figure 1:
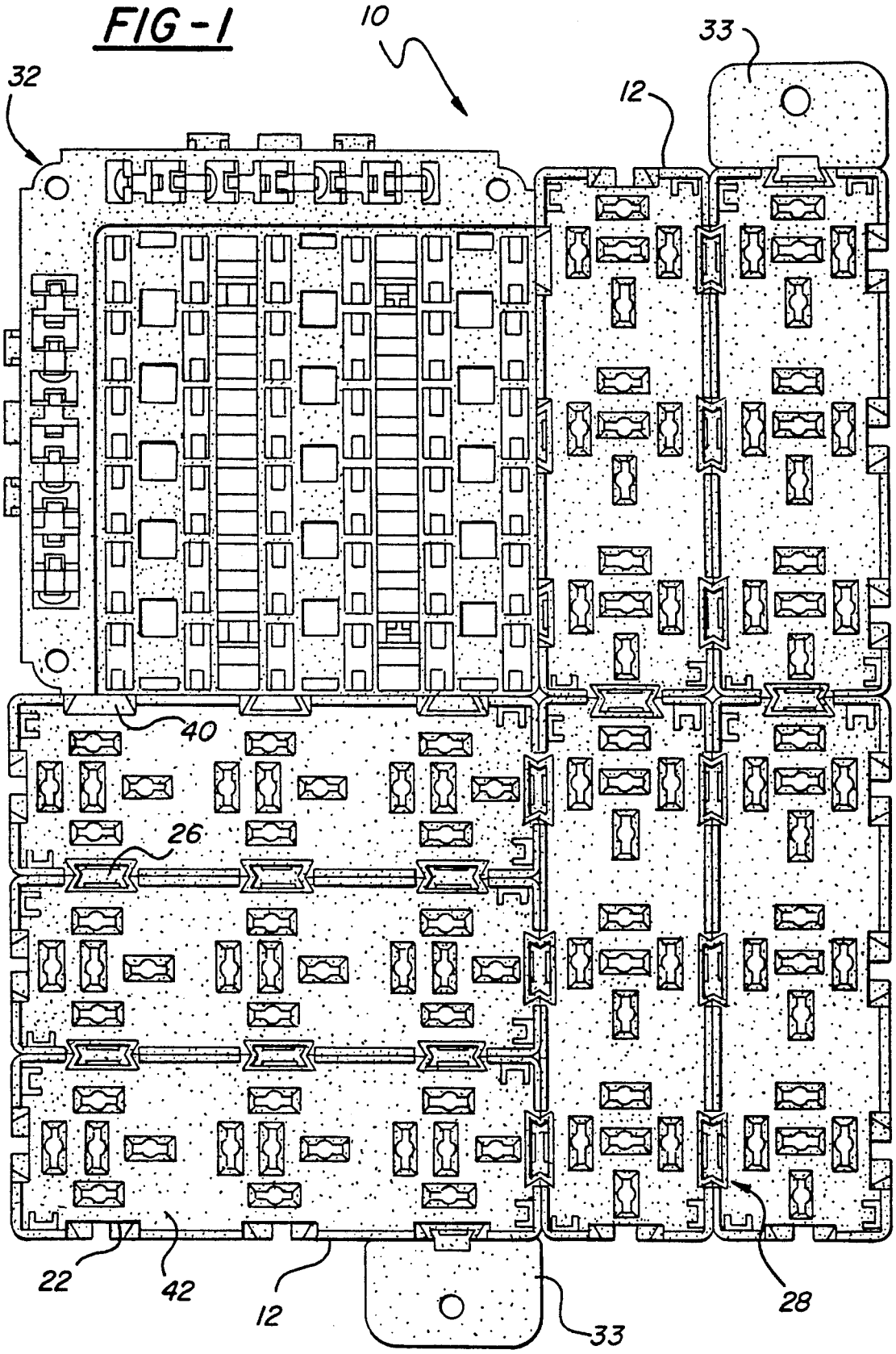
FIG. 1 is a schematic elevational view showing one of many possible arrangements of the modular assembly of the present invention.

Throughout the following detailed description, like reference numerals are used to reference the same element of the invention shown in multiple figures thereof.

Figure 2:
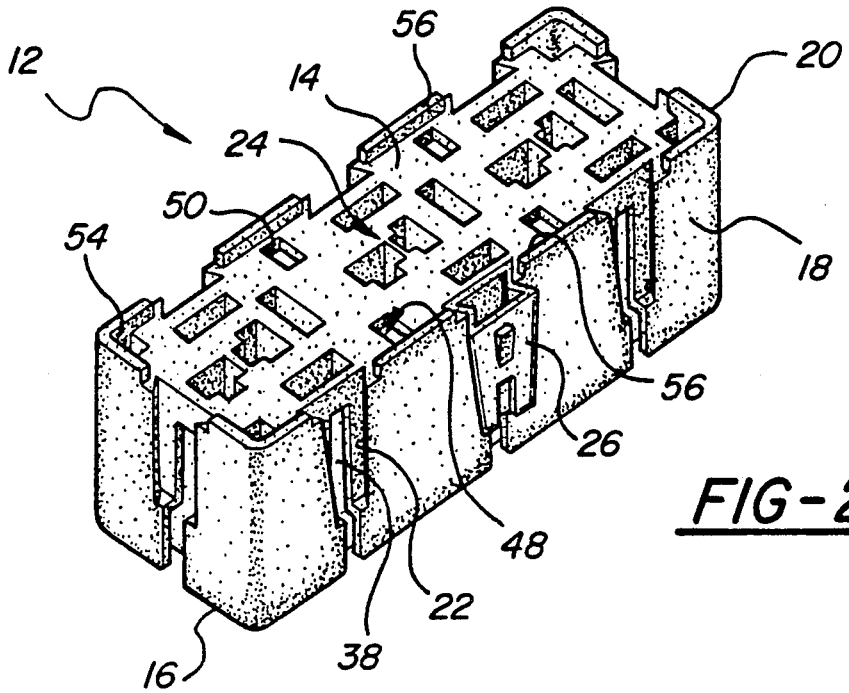
FIG. 2 is a perspective view showing several modular blocks of the assembly of FIG. 1 locked together.

Referring now to the drawings, and in particular to FIGS. 1 and 2, there is shown a modular electrical connector assembly 10 according to the present invention. The assembly 10 comprises a plurality of parallelpiped modular blocks 12, each having top and bottom surfaces 14 and 16, and two pairs of opposed sides 18, 20. Each modular block 12 further includes at least one inwardly tapering mortise 22 formed on one of said sides 18, 20 an extending for a distance on said side toward said top surface 14 and said bottom surface 16. Each modular block 12 of the assembly also has socket means 24 formed on the top surface 14 thereof for insertion of an electrical connection elment (not depicted) such as a relay; a terminal element; an electical fuse; a lamp socket; a connector; a stud, or a diode.

Figure 3A:
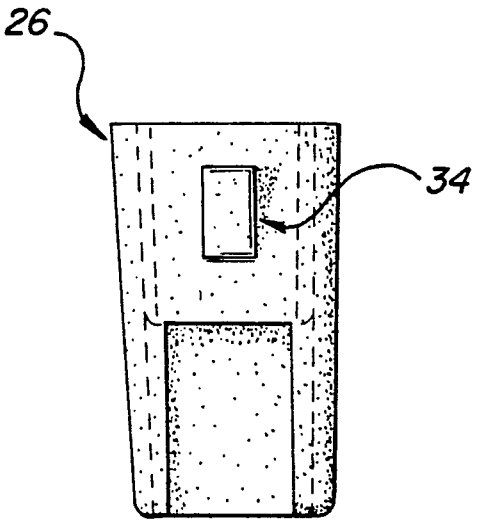
FIGS. 3A and 3B are, respectively front and side elevational views of the tubular wedge used to lock together the assembly of the present invention.
Figure 3B:
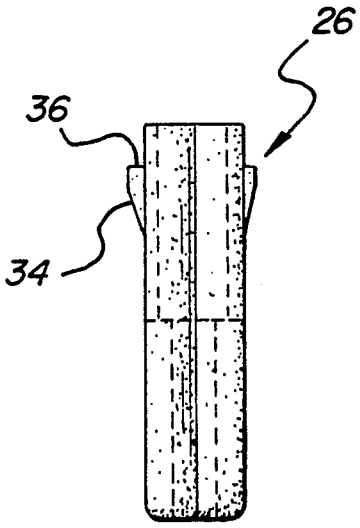
Figure 4B:
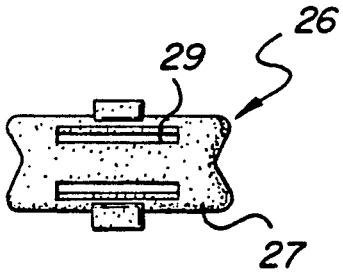
FIGS. 4A and 4B are, respectively, top and bottom views of the tubular wedge of FIG. 3A.
Figure 4A:
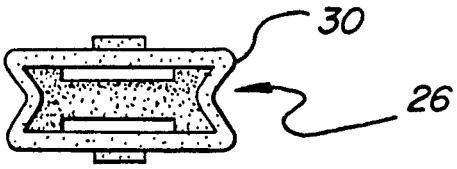

The assembly 10 further comprises a plurality of hollow, single walled, tubular wedges 26, an example of such wedge 26 being depiced in detail in FIGS. 3A-4. Each tubular wedge 26 is configured to include a pair of opposed, outwardly flaring tenons 30 for mating engagement with at least one mortise 22 to form a dovetail joint 28 therewith. Preferably, a first engagement means in the form of an upwardly extending ramp 34 is formed on each tenon 30. Each upwardly extending ramp 34 terminates in an upwardly depending stop 36. Stop 36 is designed to engage downwardly depending stop surface 38 which is formed down the middle of each omrtise 22 on each module block 12. the abutment of the upwardly depending stop 36 on the tenons 30 of the wedges 26 with the downwardly depending stop surfaces 38 of the mortises 22 of the modular blocks 12 prevents relative vertical motion of the modular blocks 12 with respect to the wedges 26, and, therefore, of the modular blocks 12 with respect to each other.

Thus, to assemble a modular electrical connector assembly such as connector assembly 10 depicted on the figures, the correct number of modular blocks 12 are selected to accommodate the electrical connection elements necessary for the wiring system of a particular vehicle. In many cases, it may be necessary to also include a special module 32 (depicted in FIG. 1) which is especially designed to accommodate the insertion of a plurality of electrical fuses or circuit breakers. In the case of special modules such as module 32, a plurality of single tenons 40 are integrally formed around the edges of the module 32 so that the module 32 may be interconnected with any of the plurality of modular blocks 12 without the necessity of using wedge 26. Furthermore, a plurality of brackets 33, also formed with a single tenon thereon, may be attached to the modular assembly 10 so that the assembly 10 may be suitably mounted under the hood of each vehicle. Obviously, a variety of designs of brackets 33 may be necessary to customize each assembly 10 for individual vehicles.

After the various modular blocks 12 have been selected and arranged into the desired configuration, they are attached to each other by insertion of an appropriate number of tubular wedges 26. Because of their tubular construction, the wedges 26 are easily insertable into the assembly to form dovetail joints 2 with the mortises 22 of the modular blocks 12. As stated before, the engagement of the stop 36 with the stop surface 38 prevents relative vertical motion between the various components of the assembly 10. Moreover, because the wedges 26 are hollow, thin walled, and formed of a resilient material such as a molded polymer, the opposed tenons 30 thereof can be compressed toward each other when the wedges 26 are used to lock the modular blocks 12 together. These compressed tenons 30 naturally will exert force against the mortises with which they are engaged, thus helping to hold the stop 36 in engagement with the stop surface 38. The tubular configurations of the wedges 26 thus contributes greatly to maintaining the integrity of the joints 28 even when the assembly 10 is subjected to the mechanical and thermal shocks attendant with typical vehicular operating environments.

FIG. 4B depicts the bottom configuration of the wedge 26. It has been found that configuring the bottom to include two opposed pairs of outwardly flaring wings 27 disposed on a central stem 29 gives the wedge 26 great mechanical strength.

Optionally, the coefficient of thermal expansion of the modular blocks 12 is different from that of the wedges 26 so that heating of the assembly 10 caused by operation of the vehicle, and other environmental factors, results in differential swelling of the blocks with respect to the wedges. Thus, the dovetail joints 28 therebetween will tighten in such circumstances, rather than loosen, as is true of the prior art modular systems. Hence, the assembly of the present invention preserves its integrity over long periods of use under harsh operating conditions. Preferably, the coefficient of thermal expansion of the wedges 26 is greater than the coefficient of thermal expansion of the modular blocks 12 so that the tenons will swell with respect to the mortises, thus tightening the dovetail joints. It has been found that if the wedges are formed of Valox® 430 brand polybutyl, terepthalate reinforced with 30% glass fibers, and the modular blocks are formed of Valox® DR-51 brand polybutyl terepthalate reinforced with 15% glass fibers, good joint integrity will be maintained.

The modular assembly 10 of the present invention, in another preferred embodiment thereof, further comprises a prelocking wedge 42 which is insertable into each modular block 12. Each prelocking wedge 42 is movable from a first position (depicted, in FIG. 6) wherein the electrical connection elements may be inserted into the sockets 24, tested for electrical integrity, and removed therefrom if necessary, to a second, position, depicted in FIG. 1, wherein the connection elements are permanently locked in the sockets 24.

In order to accomplish this, the prelocking wedge 42 is provided with a plurality of finger members 44, one of which is depicted in detail in FIG. 5A. Each finger member 44 is provided with a stop 46 on a free end 47 thereof. As can be seen in FIGS. 2 and 6, each modular block 12 is provided with a plurality of apertures 48 corresponding to the finger members 44. A stop surface 50 is formed by the outer edge of each aperture 48. When the prelocking wedge 42 is in the first position depicted in FIG. 6, the stop 46 engages the stop surface 50 of the corresponding aperture 48, thus preventing further insertion of the prelocking wedge 42 into the modular block 12.

However, as can best be seen in FIG. 5A, the finger member 44 is inwardly displaceable from the first position into a second position (shown in phantom in FIG. 5A) wherein the stop 46 disengages from the stop surface 50 of the aperture 48 so that the entire finger member 44 may be inserted into its corresponding aperture 48. Thus the prelocking wedge 42 may be fully inserted into the modular block 12 until it is substantially flush with the top surface 18 thereof, thus achieving the locked position shown in the assembled modular assembly of FIG. 1.

By using the prelocking wedges 42 of the present invention, the electrical connection elements may be correctly aligned and inserted into the appropriate sockets 24 of the modular blocks 12. The connection elements may then be tested for electrical integrity, removed, if necessary, and reinserted. The modular assembly 10 may be shipped with the prelocking wedges in the first position. In addition to engagement between the stop 46 and stop surface 50 the prelocking wedge 42 is held within the modular block 12 in its first position by means of locking fingers 52 which extend from prelocking wedge 42 into mating apertures formed in modular blocks 12. Additionally, each modular block 12 is formed with an outer rim 56 which prevents accidental vertical displacement of prelocking wedge 42 when in the first position. However, in the first position, prelocking wedge 42 may be easily removed from modular block 12. After the units have been shipped, it is frequently necessary to test the electrical integrity of each connection, as is more fully explained in U.S. Pat. No. 5,100,336, which is assigned to the assignee of the present application and the disclosure of which is herein incorporated by reference. After the connections have been tested, the prelocking wedge 42 may then be moved to the final position by pushing finger members 44 inwardly to disengage the stops 46, 50. Prelocking wedge 42 may then be fully inserted into modular block 12, thereby locking the electrical connection elements into the assembly. Alternatively, the connection elements may be tested and the prelocking wedge 42 locked into its final position by use of a continuity block which is specifically designed to test the connections and then automatically set the finger members 44.

The modular electrical connector assembly of the present invention provides the advantages of: flexibility for use with individual vehicle wiring systems; thermal integrity of the joints between the modules; and the ability to preposition the electrical connections and test their electrical integrity without locking them therein. Furthermore, the double sided tenon wedge of the present invention is easy to manufacture and to insert into the modular blocks. Obviously, the components of the modular assembly of the present invention may be rearranged into a variety of configurations, and may include provisions for electrical connections not herein enumerated. Such variations may occur to one skilled in the art without departing from the spirit of the present invention. Thus, while the present invention has been described with respect to certain embodiments and exemplifications thereof, its scope is not intended to be limited to the embodiments and exemplifications depicted and described. Rather, the scope of the present invention is solely limited by the claims appended hereto and all reasonable equivalents thereof.

We claim:

1. A modular electrical connector assembly comprising:

a plurality of parallelepieped modules, each having top and bottom surfaces and two pairs of opposed sides, and each including at least one inwardly tapering mortise formed on one of said sides and extending for a distance on said side toward said top surface and said bottom surface;

socket means formed on the top surface of each of said plurality of modules for insertion of an electrical connection element therein; and a plurality of resilient tubular wedges, each configured to include a pair of opposed, outwardly flaring tenons for mating engagement with said at least one mortise to form a dovetail joint therewith.

2. The assembly of claim 1 wherein said modules have a coefficient of thermal expansion differing from the coefficient of thermal expansion of said wedges such that heating said dovetail joint causes differential swelling of said mortise relative to said tenon, thereby tightening said joint.

3. The assembly of claim 1 wherein the socket means of at least one of said plurality of modules is configured to receive an electrical connection element therein selected form the group consisting of:

a relay; a terminal element; an electrical fuse; a lamp socket; a connector; a stud; and a diode.

4. The assembly of claim 1 wherein at least one of said plurality of modules further comprises a plurality of inwardly tapering mortises formed on the sides thereof.

5. The assembly of claim 4 wherein said at least one module further includes said plurality of mortises formed on a first side thereof.

6. The assembly of claim 4 wherein said at least one module further includes said plurality of mortises formed on at least first and second sides thereof.

7. The assembly of claim 1 wherein each of said plurality of wedges further comprises a first engagement means formed on each of said opposed tenons for locking engagement with a second engagement means formed on said at least one mortise.

8. The assembly of claim 7 wherein said first engagement means comprises an upwardly extending ramp terminating in an upwardly depending stop, and said second engagement means comprises a downwardly depending stop, the abutment of said upwardly depending stop with said downwardly depending stop defining the engagement between the first and second locking surfaces to prevent relative, vertical motion between said modules and said wedges.

9. The assembly of claim 1 wherein at least one of said plurality of modules further includes at least one tubular wedge built into a side thereof for engagement with the mortise of another of said plurality of modules.

10. The assembly of claim wherein the coefficient of thermal expansion of said wedges is greater than that of said modules.

11. The assembly of claim 1, wherein the coefficient of thermal expansion of said modules is greater than that of said wedges.

12. The assembly of claim 1 further comprising a prelocking wedge insertable into the assembly and including at least one locking finger operable to retain the wedge in a first position relative to the assembly such that said electrical connections may be inserted into said sockets, said locking finger being inwardly displaceable so as to allow said prelocking wedge to move to a second position to lock the electrical connections therein.

13. The assembly of claim 12 wherein said locking finger further comprises a stop engagable with a stop surface formed on one of said modules.

14. The assembly of claim 13 wherein said module further comprises an aperture configured to receive said locking finger when said prelocking wedge is in said second position, said stop surface being formed on an edge of said aperture.

15. A wedge for interlocking a plurality of modular blocks together to form an electrical connector assembly, each of said blocks including at least one inwardly tapering mortise formed on a side thereof, said wedge comprising:

a hollow, resilient, single walled body with opposed, outer faces, each of said faces including an outwardly flaring tenon formed thereon for engagement with said mortise to form a dovetail joint therebetween and an upwardly tapering ramp formed on said tenon and terminating in an upwardly depending stop surface for engagement with a downwardly depending stop surface formed on said mortise of each of said blocks to prevent relative vertical movement between said wedge and said blocks.

16. The wedge of claim 15 wherein the wedge has a coefficient of thermal expansion different from that of said blocks such that heating said dovetail joint causes differential expansion of the mortise relative to the tenon, thereby tightening the joint.

17. The wedge of claim 16 wherein the wedge has a coefficient of thermal expansion greater than that of said blocks.

18. The wedge of claim 15 wherein the wedge is formed of polybutyl terepthalate reinforced with 30% glass fibers, and the blocks are formed of polybutyl terepthalate reinforced with 15% glass fibers.

* * * * *

UNITED STATES PATENT AND TRADEMARK OFFICE

CERTIFICATE OF CORRECTION

PATENT NO. : 5,295,870

DATED : March 22, 1994

INVENTOR(S) : Mark W. Rei,et al.

It is certified that error appears in the above-indentified patent and that said Letters Patent is hereby corrected as shown below:

Column 1, Line 43, please delete "4,269,470" and insert -- 3,269,470--.

Column 3, Line 18-19, please delete "parallelpiped" and insert --parallelpieped--.

Column 3, Line 41-42, please delete "omrtise" and insert --mortise--.

Column 3, Line 42, please delete "the" (first occurence) and insert --The--.

Column 3, Line 50, please delete "on" and insert --in--.

Column 4, Line 6, please delete "2" and insert --28--.

Column 4, Line 54, please remove "," after depicted.

Column 6, Line 58, after"claim" please insert --1--.

Signed and Sealed this

Twenty-sixth Day of July, 1994

*Attest:*

Bruce Lehman

BRUCE LEHMAN

*Attesting Officer*

*Commissioner of Patents and Trademarks*